US008519368B2

(12) United States Patent
Neff et al.

(10) Patent No.: US 8,519,368 B2
(45) Date of Patent: Aug. 27, 2013

(54) METHOD AND DEVICE FOR GENERATING EUV RADIATION OR SOFT X-RAYS

(75) Inventors: Jakob Willi Neff, Kelmis (BE); Dominik Marcel Vaudrevange, Neuss (DE); Peter Zink, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 240 days.

(21) Appl. No.: 13/054,807

(22) PCT Filed: Jul. 21, 2009

(86) PCT No.: PCT/IB2009/053146

§ 371 (c)(1),
(2), (4) Date: Jan. 19, 2011

(87) PCT Pub. No.: WO2010/013167

PCT Pub. Date: Feb. 4, 2010

(65) Prior Publication Data

US 2011/0127442 A1 Jun. 2, 2011

(30) Foreign Application Priority Data

Jul. 28, 2008 (EP) ..... 08104888

(51) Int. Cl.
*H05G 2/00* (2006.01)

(52) U.S. Cl.
USPC ..... 250/504 R; 250/372

(58) Field of Classification Search
USPC ..... 250/372, 336.1, 504 R
See application file for complete search history.

(56) References Cited

U.S. PATENT DOCUMENTS

| | | | | |
|---|---|---|---|---|
| 3,605,048 | A * | 9/1971 | Sargent, III | 355/83 |
| 6,252,650 | B1 * | 6/2001 | Nakamura | 355/69 |
| 7,126,143 | B2 * | 10/2006 | Klein et al. | 250/504 R |
| 7,385,205 | B2 * | 6/2008 | Pearl | 250/491.1 |
| 2005/0025280 | A1 | 2/2005 | Schulte | |
| 2007/0090304 | A1 | 4/2007 | Jonkers | |
| 2008/0017810 | A1 | 1/2008 | Frijns | |

FOREIGN PATENT DOCUMENTS

| | | | |
|---|---|---|---|
| DE | 10342239 | A1 | 6/2005 |
| WO | 2006134513 | A2 | 12/2006 |
| WO | 2008029327 | A2 | 3/2008 |

* cited by examiner

*Primary Examiner* — David Porta
*Assistant Examiner* — Gisselle Gutierrez

(57) ABSTRACT

The present invention relates to a method and device for generating optical radiation, in particular EUV radiation or soft x-rays, by means of an electrically operated discharge. A plasma (15) is ignited in a gaseous medium between at least two electrodes (1, 2), wherein said gaseous medium is produced at least partly from a liquid material (6) which is applied to a surface moving in the discharge space and is at least partially evaporated by one or several pulsed energy beams. In the proposed method and device the pulses (9) of said pulsed energy beams are directed to at least two different lateral locations with respect to a moving direction of said surface. With this measure, the radiation emission volume is expanded, less sensitive to spatial fluctuations and can be adapted better to the requirements of optical systems of any applications. Furthermore, the optical output power can be increased by this measure.

15 Claims, 3 Drawing Sheets

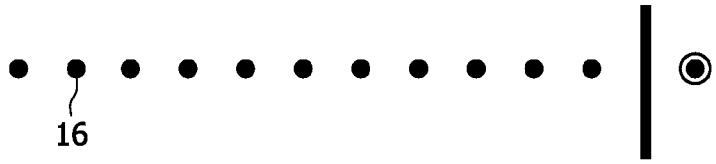
FIG. 2
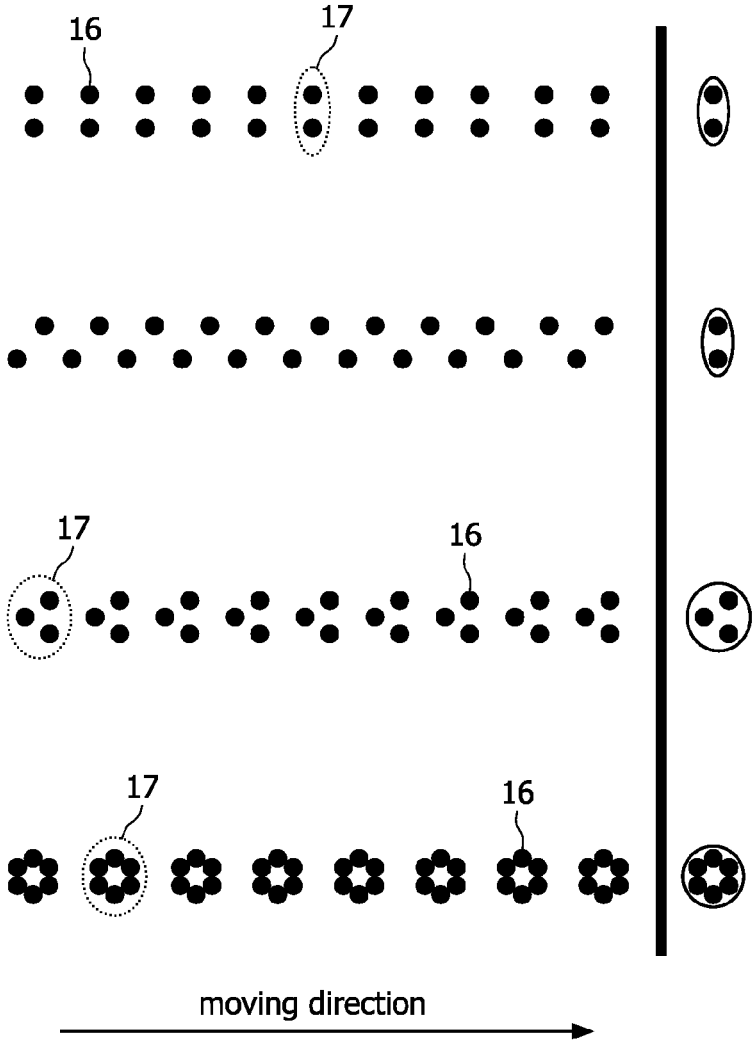
FIG. 3a
FIG. 3b
FIG. 3c
FIG. 3d

METHOD AND DEVICE FOR GENERATING EUV RADIATION OR SOFT X-RAYS

FIELD OF THE INVENTION

The present invention relates to a method and device for generating optical radiation, in particular EUV radiation or soft x-rays, by means of an electrically operated discharge, wherein a plasma is ignited in a gaseous medium between at least two electrodes in a discharge space, said plasma emitting said radiation that is to be generated, and wherein said gaseous medium is produced at least partly from a liquid material which is applied to a surface moving in said discharge space and is at least partially evaporated by one or several pulsed energy beams. Such discharge based light sources emitting EUV radiation or soft x-rays, in particular in the wavelength range between approx. 1 and 20 nm, are mainly required in the field of EUV lithography and metrology.

BACKGROUND OF THE INVENTION

In light sources of the above kind the radiation is emitted from a hot plasma produced by a pulsed current. Very powerful EUV radiation generating devices are operated with metal vapor to generate the required plasma. An example of such a device is shown in WO 2005/025280 A2. In this known EUV radiation generating device the metal vapor is produced from a metal melt which is applied to a surface in the discharge space and at least partially evaporated by a pulsed energy beam, in particular a laser beam. In a preferred embodiment of this device the two electrodes are rotatably mounted forming electrode wheels which are rotated during operation of the device. The electrode wheels dip during rotation into containers with the metal melt. A pulsed laser beam is directed directly to the surface of one of the electrodes in order to generate the metal vapor from the applied metal melt. This evaporation leads to a short circuit between the two electrodes which are connected to a charged capacitor bank, thus igniting the electrical discharge. The resulting current heats the metal vapor such that the desired ionization stages are excited and radiation of the desired wavelength is emitted from a pinch plasma.

With such a technique for generating EUV radiation spatial fluctuations of the discharge region may occur which are not negligible due to the small discharge volume of the pinch plasma. Furthermore, the geometrical form of the EUV or soft x-rays emitting volume normally is not adapted to the optical system using this EUV radiation or soft x-rays, which often comprises circular apertures for guiding the EUV radiation to the reticle and the wafer in case of EUV lithography, for example. Therefore, in such applications the EUV radiation or soft x-rays may not be used effectively.

SUMMARY OF THE INVENTION

It is an object of the present invention to provide a method and device for generating optical radiation, in particular EUV radiation or soft x-rays, by means of an electrically operated discharge, which allow a more effective use of the generated optical radiation on the one hand and achieve a higher output power of the device on the other hand.

The object is achieved with the device and the method according to claims 1 and 9. Advantageous embodiments of the method and device are subject of the dependent claims and are furthermore described in the following portions of the description.

In the proposed method a plasma is ignited in a gaseous medium between at least two electrodes in a discharge space, said plasma emitting the radiation that is to be generated. The gaseous medium is produced at least partly from a liquid material, in particular a metal melt, which is applied to a surface moving in the discharge space and is at least partially evaporated by one or several pulsed energy beams, which may be, for example, ion or electron beams and in a preferred embodiment are laser beams. The pulses of the pulsed energy beams are directed to at least two different lateral locations on said surface with respect to a moving direction of said surface.

The corresponding device comprises at least two electrodes arranged in a discharge space at a distance from one another which allows ignition of a plasma in a gaseous medium between the electrodes, a device for applying a liquid material to a surface moving in said discharge space and an energy beam device adapted to direct one or several pulsed energy beams onto said surface evaporating said applied liquid material at least partially and thereby producing at least part of said gaseous medium. The energy beam device is designed to apply pulses of said pulsed energy beams on said surface at least two different lateral locations with respect to the moving direction of said surface. The proposed device may otherwise be constructed like the device described in WO 2005/025280 A2, which is incorporated herein by reference.

A main aspect of the proposed method and device is to apply the energy beam pulses for ignition of the plasma or discharge not only at one lateral position with respect to the moving direction of the moving surface but at different lateral positions or locations with respect to said moving direction. In the present description the term lateral means a direction on the surface perpendicular to the moving direction of this surface. With this technique the discharge volume is expanded in directions in which this volume normally has only a small extension. Since the spatial fluctuations of the discharge cloud or volume do not change compared to the application of only a single pulse, the relative fluctuations of the discharge volume are smaller with the proposed method and device. Furthermore, by distributing the impact points of the energy beam pulses on the moving surface appropriately, the light emission volume, which is the discharge volume, can be shaped in the right way in order to optimally adapt the light emission volume to the acceptance area of an optical system, for example the optical system of a lithography scanner, thus allowing a more effective use of the generated radiation. A further advantage of the proposed method and device is the possibility to increase the light output power, i.e. the power of the generated optical radiation. In known EUV radiation generating devices as described in the introductory portion of this description, the light output power is limited since the pulse to pulse interval has to be adapted to the moving speed of the moving surface such that a distance is kept between the impact points on the moving surface for evaporating the liquid material. By applying the pulses at different lateral positions relative to the moving direction, a higher number of pulses can be applied at the same time interval and moving speed of the surface while keeping the required distance.

In an advantageous embodiment, the energy beam pulses are applied to the moving surface such that a periodically repeating pattern of impact points is achieved on the moving surface. This pattern results as a combination of the movement of the surface, the time intervals between the pulses and the lateral distribution of the pulses. For example, the pattern may be selected to approximate a circular distribution of impact points or may be selected to comprise three impact points resulting from three pulses, each of these impact points forming a corner of an isosceles triangle.

The several pulses forming each pattern may be generated by using several energy beam sources, for example several laser light sources, which are focused to the different locations on the moving surface to achieve the pattern. The several pulses may also be generated by only a single energy beam source and an appropriate deflection or scanning system, for example a scanning or rotating optics, in order to direct the pulses to the different locations.

In one embodiment of the proposed device and method the spatial distribution of the light emitting volume is measured as an emission characteristics of the generated optical radiation. The measurement data are used in a feedback control to achieve a desired geometry of this emission volume as close as possible. The feedback control varies the voltage, up to which the capacitor unit connected to the electrodes is charged and optionally also the pulse energy of the individual energy beam pulses of each pattern, in order to approximate the desired emission volume. With the variation of the voltage, the charged pulse energy as well as the resulting discharge current are changed. In devices using a more complex network controlling form and energy of the current pulses, the feedback control influences the network to vary form and energy of the current pulses. In the same manner, the light output power and/or the temporal stability of the generated optical radiation may be controlled. The measurements may be performed with appropriate radiation detectors like backlighted CCD-cameras or photo-diodes.

In another embodiment also comprising such a feedback control, an aperture is arranged in the optical path of the generated optical radiation. Several radiation sensors are arranged at the edges or borders of the aperture opening in order to detect radiation not passing through the aperture opening an emission characteristics of said generated optical radiation. The feedback control may then be performed by minimizing the radiation detected by the radiation sensors. At the same time the radiation energy passing through the aperture opening may be measured in order to maximize this radiation. Another possibility for the feedback control is to maximize the optical radiation passing through the aperture opening and to achieve at the same time an approximately equal amount of radiation detected by each of the sensors.

BRIEF DESCRIPTION OF THE DRAWINGS

The proposed method and device are described in the following in connection with the accompanying drawings without limiting the scope of the claims. The figures show:

FIG. 2 a schematic view of impact points on a moving surface generated with a device of the prior art;

FIG. 3*a-d* a schematic view of patterns of impact points on the moving surface generated with the proposed method and device;

DETAILED DESCRIPTION OF EMBODIMENTS

Figure 1:
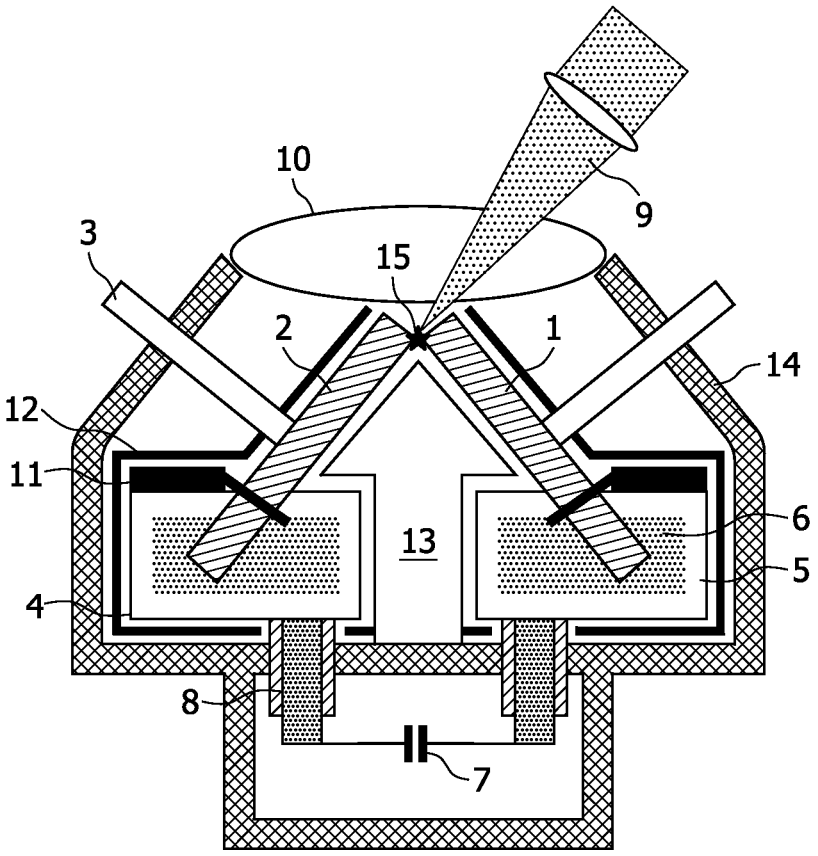
FIG. 1 a schematic view of a device for generating EUV radiation or soft x-rays.

FIG. 1 shows a schematic side view of a device for generating EUV radiation or soft x-rays to which the present method can be applied and which may be part of the device of the present invention. The device comprises two electrodes 1, 2 arranged in a vacuum chamber. The disc shaped electrodes 1, 2 are rotatably mounted, i.e. they are rotated during operation about rotational axis 3. During rotation the electrodes 1, 2 partially dip into corresponding containers 4, 5. Each of these containers 4, 5 contains a metal melt 6, in the present case liquid tin. The metal melt 6 is kept on a temperature of approximately 300° C., i.e. slightly above the melting point of 230° C. of tin. The metal melt 6 in the containers 4, 5 is maintained at the above operation temperature by a heating device or a cooling device (not shown in the figure) connected to the containers. During rotation the surface of the electrodes 1, 2 is wetted by the liquid metal so that a liquid metal film forms on said electrodes. The layer thickness of the liquid metal on the electrodes 1, 2 can be controlled by means of strippers 11 typically in the range between 0.5 to 40 μm. The current to the electrodes 1, 2 is supplied via the metal melt 6, which is connected to the capacitor bank 7 via an insulated feed through 8.

With such a device, the surface of the electrodes is continuously regenerated so that no discharge wear of the base material of the electrodes occurs. The rotation of the electrode wheels through the metal melt results in a close heat contact between the electrodes and the metal melt such that the electrode wheels heated by the gas discharge can release their heat effectively to the melt. The low ohmic resistance between the electrode wheels and the metal melt furthermore allows to conduct very high currents which are necessary to generate a sufficiently hot plasma for EUV radiation generation. A rotation of the capacitor bank delivering the current or elaborate current contacts are not required. The current can be delivered stationary via one or several feed throughs from outside of the metal melt.

The electrode wheels are advantageously arranged in a vacuum system with a basic vacuum of at least $10^{-4}$ hPa ($10^{-4}$ mbar). With such a vacuum a high voltage can be applied to the electrodes, for example a voltage of between 2 to 10 kV, without causing any uncontrolled electrical breakdown. This electrical breakdown is started in a controlled manner by an appropriate pulse of a pulsed energy beam, in the present example a laser pulse. The laser pulse 9 is focused on one of the electrodes 1, 2 at the narrowest point between the two electrodes, as shown in the figure. As a result, part of the metal film on the electrodes 1, 2 evaporates and bridges over the electrode gap. This leads to a disruptive discharge at this point accompanied by a very high current from the capacitor bank 7. The current heats the metal vapor, also called fuel in this context, to such high temperatures that the latter is ionized and emits the desired EUV radiation in a pinch plasma 15.

In order to prevent the fuel from escaping from the device, a debris mitigation unit 10 is arranged in front of the device. This debris mitigation unit 10 allows the straight pass of radiation out of the device but retains a high amount of debris particles on their way out of the device. In order to avoid the contamination of the housing 14 of the device a screen 12 may be arranged between the electrodes 1, 2 and the housing 14. An additional metal screen 13 may be arranged between the electrodes 1, 2 allowing the condensed metal to flow back into the two containers 4, 5.

With such a EUV generating device, when used and constructed according to the prior art, the laser pulses are applied to the surface of the rotating electrode wheel 2 always at the same lateral position on this wheel. The resulting trace of impact points 16 is therefore on a straight line on this surface as indicated in FIG. 2. Each discharge results from the evaporation of the tin at a fixed point, which is the point of impact of the corresponding laser pulse. The EUV emission region is therefore always strongly localized at a fixed spatial position. The physical processes of plasma extension and heating result in an approximately cylindrical discharge volume or light emission volume of approximately 0.1 mm in diameter and 1 mm in length. Due to statistical fluctuations the length and position of this volume may vary in all directions by 0.03 mm. These fluctuations therefore have a very high relative effect in the direction of the diameter and may cause that strong specifications regarding the stability of the spatial radiation distribution, which are set by the optical system, can not be fulfilled.

This drawback is overcome using a device or method according to the present invention in which—with respect to a device as in FIG. 1—several laser pulses are applied at least two different lateral locations with respect to the moving direction of the surface of the rotating electrode wheel. With such a distribution of laser pulses or laser pulse impacts on the tin surface a plasma pinch or radiation emitting volume is formed which has—averaged over several discharges—a higher extension in the direction of the diameter, i.e. a larger diameter, compared to the above prior art. With such a larger diameter or extension in radial direction the relative spatial fluctuations are reduced. The device of FIG. 1 only has to be adapted to obtain such a distribution of laser pulses on the surface of the electrode wheel. This may be achieved by using several laser light sources focusing at different locations on the electrode wheel or by using a rotational or scanning optics between the laser light source and the surface of the electrode wheel.

In a device as shown in FIG. 1, the maximum EUV radiation power achievable is limited as follows. The rotation speed of the electrode wheels is limited by different factors. Two discharges in succession must be generated via spatially different regions of the surface of the electrode wheels in order to ensure that always a new or fresh portion of the tin film is used. The distance between two impact points should for example be 0.3 mm. Applying the laser pulses at only one fix lateral position at the surface, a structure of impact points is generated at the moving surface as indicated in FIG. 2. Using on the other hand several laser pulses at different lateral positions with respect the moving direction of the surface according to the proposed method or device, dependent on the time interval between the laser pulses relative to the rotation speed of the electrode wheels an output power up to the double power of the conventional device can be achieved when applying two pulses for each discharge at two different lateral positions. Depending on the time interval between these two pulses a pattern 17 of impact points 16 as indicated in FIGS. 3*a* and 3*b* is achieved on the surface. If the two laser pulses are applied in a very short time interval compared to the rotating speed of the electrode wheels, for example with a time interval of 20 μs, a pattern like in FIG. 3*a* is achieved. If all of the pulses are applied at the same time interval, a zigzag pattern as indicated in FIG. 3*b* is achieved.

Using three laser pulses for a pattern or electrical discharge, a structure approximating an isosceles triangle may be achieved as indicated in FIG. 3*c*. Each of the impact points 16 is on the corner of the triangle. Such a pattern combines the advantage of the enhanced output power with the advantage of the larger emission region or volume of EUV radiation. This emission region is indicated with the closed circles on the right hand side in each or the FIGS. 2 and 3 *a-d*. The three laser pulses to this end may be applied in very short distance in time compared to the rotation speed of the electrode wheels. The next discharge is then generated after a larger time interval as can be recognized from FIG. 3*c*.

Figure 4:
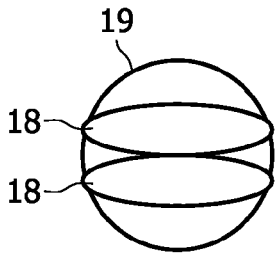
FIG. 4 a schematic view showing two cylindrical EUV emission regions mapped to the plane of an aperture.

The application of a device for generating EUV radiation or soft x-rays requires the use of an optical system for beam shaping or beam guiding of the radiation. The system etendue is often achieved by circular aperture openings of the optical system. The typical cylindrical emission volume of the devices of the prior art are only adapted to such an aperture, if the cylinder axis coincides with the optical axis of the optical system. This condition however in most cases is not fulfilled. In these cases the cylinder axis of the emission or discharge volume may be oriented perpendicular to the optical axis and thus parallel to the surface of the aperture. With the proposed method and device, the cylindrical emission volume may be extended by several partial emission regions in the direction of the cylinder diameter to better match the circular aperture opening. This is indicated in FIG. 4, which shows an aperture opening 19 to which two abutting partial cylindrical emission volumes 18 are mapped. As is obvious from this figure, two abutting or partly overlapping partial cylindrical emission volumes better match the circular aperture opening 19 than only a single cylindrical emission volume. Generating even more than two such partial emission volumes by using more than two laser pulses applied to different lateral locations on the surface, the circular aperture can even be more effectively matched.

Figure 5:
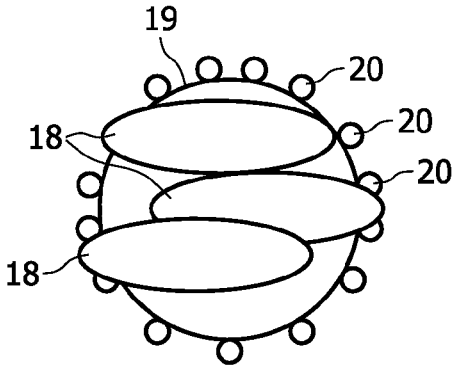
FIG. 5 a schematic view showing an aperture with surrounding radiation sensors and several EUV emission regions mapped to the plane of the aperture.

The matching of the discharge or emission volume to the circular aperture may be measured in order to control the generation of the discharge volume by a control unit 23 (see FIG. 6) such that a maximum amount of EUV radiation passes through the aperture. To this end, several radiation sensors 20 may be arranged at the border of the aperture opening 19 in order to measure EUV radiation which impinges on this border and does not pass through the aperture opening 19. A schematic view of such an embodiment is shown in FIG. 5 with the aperture opening 19 and the surrounding radiation sensors 20. In this figure, three overlapping partial cylindrical emission volumes 18 are mapped to the plane of the aperture opening 19. The single pulses causing these partial emissions may be controlled such that the radiation detected by the radiation sensors 20 is minimized and at the same time the amount of EUV radiation passing through the aperture opening 19 is maximized. When the detectors deliver similar signals for the different azimuth angles, an optimal adaptation of the emission volume to the circular aperture opening 19 is achieved.

The different laser pulses impinging on different lateral positions with respect to the moving direction of the electrode wheels may be applied by different laser light sources. For example, three laser light sources may be arranged to focus their laser pulses to three different locations at the surface of the electrode wheel. The pattern of impact points achieved is also influenced by the relation of the time intervals between the three laser pulses and the radiation speed of the electrode wheels.

Figure 6:
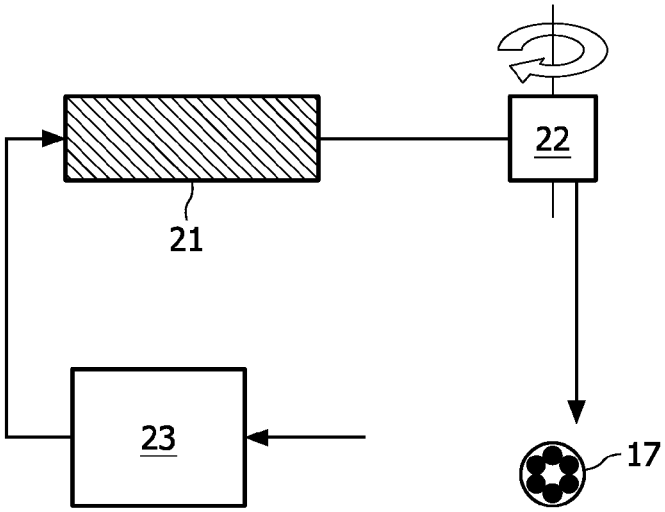
FIG. 6 a schematic view of a laser with a rotating or scanning optics used in an embodiment of the proposed device and method.

Another possibility is to use only a single laser light source, whose laser beam is scanned with a rotating optics in a circular manner over the surface of the electrode wheel. FIG. 6 shows such an embodiment with a single laser light source 21 and a rotating or scanning optics 22 in order to achieve a nearly circular pattern 17 on the surface of the electrode wheel. If the pulse frequency of the laser pulses is an integer multiple of the rotational frequency of the electrode wheels, the impact points are always at the same location of the circumference. If the relationship is different, the pattern rotates so that integrally a nearly circular distribution is achieved.

A rotational or scanning optics has the advantage that the spatial distribution of the emission volume in azimuthal direction can be controlled very precise. Such rotational optics are known for example from the field of laser drilling if it is necessary to generate very precise circular drillings. By appropriately selecting the time intervals between the pulses relative to the moving speed of the moving surface also a nearly homogeneous distribution of the impact points within each pattern can be achieved. With such a homogeneous distribution of impact points the tin surface is optimally used, which also results in a maximization of the output power of the device. A further embodiment of a scanner optics is based on a piezoelectrically driven mirror which can for example achieve a pattern filling the intermediate space between the two impact points in FIG. 3*a*. This results in a more homogeneous EUV emission region.

Apart from the above described control of the emission volume by radiation sensors at the borders and behind of an aperture opening, the control can also be based on a direct observation of the emission region or emission volume. In this case, radiation detectors have to be arranged which measure the EUV emission for each pulse as well as the spatial distribution of the emission volume. In all cases, the measured values are fed to a feedback system including a control unit 23 (see FIG. 6) to control the emission volume of the EUV radiation. The feedback system based on the measurement data calculates the pulse energy for each individual pulse and the voltage, to which the charger charges the capacitor bank, in order to approximate a desired geometrical form of the emission volume or another characteristics of the emission. With such a feedback system or control unit the spatial homogeneity of the EUV emission volume, the temporal stability of the EUV emission, the adaptation to an optical system and the maximum usage of the tin surface (increase in output power) may be optimized.

While the invention has been illustrated and described in detail in the drawings and foregoing description, such illustration and description are to be considered illustrative or exemplary and not restrictive. The invention is not limited to the disclosed embodiments. The different embodiments described above and in the claims can also be combined. Other variations to the disclosed embodiments can be understood and effected by those skilled in the art in practicing the claimed invention, from the study of the drawings, the disclosure and the appended claims. For example, the pattern of impact points is not limited to the patterns shown in the figures, but may have any appropriate form to achieve the desired effect. The same applies to the number of pulses respectively impact points for each pattern. The invention is also not limited to EUV radiation or soft X-rays, but may be applied for any kind of optical radiation which is emitted by an electrically operated discharge. Furthermore, the feedback control may also be based on one or several radiation sensors measuring the radiation characteristics at the application site, i.e. for example in a lithography scanner.

In the claims, the word "comprising" does not exclude other elements or steps, and the indefinite article "a" or "an" does not exclude a plurality. The mere fact that measures are recited in mutually different dependent claims does not indicate that a combination of these measures can not be used to advantage. The reference signs in the claims should not be construed as limiting the scope of these claims.

LIST OF REFERENCE SIGNS

1 electrode
2 electrode
3 rotational axis
4 container
5 container
6 metal melt
7 capacitor bank
8 feed through
9 laser pulse
10 debris mitigation unit
11 strippers
12 shield
13 metal screen
14 housing
15 pinch plasma
16 impact point
17 pattern
18 mapped emission volume
19 aperture opening
20 radiation sensors
21 laser
22 rotating or scanning optics
23 control unit

The invention claimed is:

1. A device for generating optical radiation by means of an electrically operated discharge, comprising at least two electrodes (1, 2) arranged in a discharge space at a distance from one another which allows ignition of a plasma (15) in a gaseous medium between said electrodes (1, 2), a device for applying a liquid material (6) to a surface moving through, said discharge space and an energy beam device adapted to direct one or several pulsed energy beams onto said surface evaporating said applied liquid material (6) at least partially thereby producing at least part of said gaseous medium, wherein said energy beam device is designed to apply pulses (9) of said pulsed energy beam(s) at different lateral locations with respect to a moving direction of said surface, such that a periodically repeating pattern of impact points is achieved at said surface during movement of said surface.

2. The device according to claim 1, wherein said energy beam device comprises a rotating or scanning optics (22) for applying the pulses of said pulsed energy beam(s) at the different lateral locations with respect to the moving direction of said surface.

3. The device according to claim 1, wherein said device for applying a liquid material (6) is adapted to apply the liquid material (6) to a surface of at least one of said electrodes (1, 2), said at least one of said electrodes (1, 2) being designed as a rotatable wheel which can be placed in rotation during operation.

4. The device according to claim 1, further comprising radiation sensors (20) arranged for measuring one or more characteristics of said generated optical radiation.

5. The device according to claim 4, further comprising an optical aperture arranged in a passage of the generated optical radiation, wherein several of said radiation sensors (20) are arranged at a border of an aperture opening (19) of said aperture around said aperture opening (19).

6. The device according to claim 4, further comprising a control unit (23) connected to said energy beam device and controlling a charging voltage of a capacitor unit (7) or an energy and form of a current pulse for electrically operating the discharge dependent on measurement data of said radiation sensors (20).

7. The device according to claim 4, wherein the control unit (23) is adapted to control a charging voltage of a capacitor unit (7) or an energy and form of a current pulse for electrically operating the discharge and the puke energy of each individual puke of said pulsed energy beam(s) dependent on measurement data of said radiation sensors (20).

8. The device according to claim 1, wherein said energy beam device comprises more than one laser light source.

9. A method of generating optical radiation by means of an electrically operated discharge, in which a plasma (15) is ignited in a gaseous medium between at least two electrodes (1, 2) in a discharge space, said plasma (15) emitting said radiation that is to be generated, wherein said gaseous medium is produced at least partly from a liquid material (6), which is applied to a surface moving in said discharge space and is at least partially evaporated by one or several pulsed energy beam(s), and wherein pulses (9) of said pulsed energy beam(s) are directed to different lateral locations with respect to a moving direction of said surface, such that a periodically repeating pattern of impact points is achieved at said surface during movement of said surface.

10. The method according to claim 9, wherein each of said several pulsed energy beams is generated by a different energy beam source and directed to a different lateral location with respect to the moving direction of said surface.

11. The method according to claim 9, wherein during movement of said surface said one pulsed energy beam is moved back and forth across the moving direction of said surface in order to apply the pulses of said pulsed energy beam to the different lateral locations.

12. The method according to claim 9, wherein one or more characteristics of said generated optical radiation is detected and a charging voltage of a capacitor unit (7) or an energy and form of a current pulse thr electrically operating the discharge are controlled dependent on measurement data of said detection.

13. The method according to claim 9, wherein one or more characteristics of said generated optical radiation is detected and a charging voltage of a capacitor unit (7) or an energy and form of a current pulse for electrically operating the discharge and a pulse energy of each individual pulse of said pulsed energy beam(s) are controlled dependent on measurement data of said detection.

14. A method according to claim 9, wherein at least one of said electrodes (1, 2) is set in rotation during operation, said liquid material (6) being applied to a surface of said at least one of said electrodes (1, 2).

15. A method according to claim 9, wherein said pulses are provided by more than one laser light source.

* * * * *